US012471698B2

(12) United States Patent
Cecilia

(10) Patent No.: US 12,471,698 B2
(45) Date of Patent: Nov. 18, 2025

(54) SUITCASE TRANSFORMABLE INTO A MASSAGE TABLE

(71) Applicant: Massage Products International, LLC, St. Petersburg, FL (US)

(72) Inventor: Nathalie M. Cecilia, St. Petersburg, FL (US)

(73) Assignee: Massage Products International, LLC, St. Petersburg, FL (US)

( * ) Notice: Subject to any disclaimer, the term of this patent is extended or adjusted under 35 U.S.C. 154(b) by 137 days.

(21) Appl. No.: 18/479,458

(22) Filed: Oct. 2, 2023

(65) Prior Publication Data

US 2025/0107619 A1 Apr. 3, 2025

(51) Int. Cl.
*A47B 3/10* (2006.01)
*A47B 3/00* (2006.01)

(52) U.S. Cl.
CPC ..... *A47B 3/10* (2013.01); *A47B 3/002* (2013.01)

(58) Field of Classification Search
CPC .... A61G 13/009; A61G 13/105; A47B 3/002; A47B 3/10; A47G 9/1027; A47G 2009/1018
See application file for complete search history.

(56) References Cited

U.S. PATENT DOCUMENTS 4,333,638 A * 6/1982 Gillotti ..... A47B 3/087 5/613
5,009,170 A * 4/1991 Spehar ..... A47B 3/10 108/132
7,636,967 B1 * 12/2009 Stokes ..... A61G 13/009 5/725
2002/0138911 A1 * 10/2002 Giori ..... A47C 27/084 5/709

(Continued)

FOREIGN PATENT DOCUMENTS

CN 210277602 4/2020
FR 2555422 A1 * 5/1985
GB 1299789 A * 12/1972 ..... A47C 27/088

OTHER PUBLICATIONS

International Search Report and Written Opinion issued Dec. 2, 2024 for corresponding PCT International Patent Application No. PCT/US2024/047924 with an International filing date of Sep. 23, 2024.

*Primary Examiner* — Matthew W Ing
(74) *Attorney, Agent, or Firm* — Andrew Behrens; Trenam Law

(57) ABSTRACT

A portable and transformable massage table that includes a folded configuration in which the table is easily transportable within a singular container, similar to a travel case or suitcase, as well as a deployed configuration for use in massage and/or physical therapy. During transportation in the folded configuration, each component of the table is (Continued)

contained within an internal compartment defined by the singular container, thereby facilitating the movement of the massage table between locations for use during therapy sessions. Upon arrival at a target location, the singular compartment efficiently unfolds into the deployed configuration, in which an exterior surface of the compartment serves as a surface of the massage table. In addition, the components stored within the compartment in the folded configuration are removable for use in the deployed configuration.

19 Claims, 7 Drawing Sheets

(56) References Cited

U.S. PATENT DOCUMENTS

2011/0047705 A1* 3/2011 Gorovitz ..... A61G 13/009 5/613
2015/0196446 A1* 7/2015 Yue ..... A61G 13/104 5/620

* cited by examiner

SUITCASE TRANSFORMABLE INTO A MASSAGE TABLE

BACKGROUND OF THE INVENTION

1. Field of the Invention

This invention relates, generally, to massage tables. More specifically, it relates to a portable and transformable massage table that resembles a carrying case or suitcase in a folded configuration, and that efficiently transforms into a massage table in a deployed configuration.

2. Brief Description of the Prior Art

Massage tables are commonly used in providing physical and massage therapy, during which a patient typically rests on the top surface of a massage table to receive treatment from a therapist. Massage tables can be designed in a stationary or a portable configuration; a stationary massage table is designed to remain in place without being transported to a different location, whereas portable massage tables are arranged for such transportation. Portable massage tables typically fold into a smaller configuration to facilitate transportation to a different location, either within a given space (such as a medical office or therapy location), or to a different location (such as for use by a traveling therapist).

Due to their versatility over stationary massage tables, portable massage tables have been widely used, including within singular locations, thereby allowing therapists to easily move the tables between rooms, as well as to different locations. Such portable massage tables typically include a simplistic folding mechanism that includes a central seam and a set of opposing legs. As such, in a deployed configuration, the top surface of the table forms a largely planar platform (other than the central seam) upon which a patient can rest during treatment. Similarly, in a folded configuration, the legs fold toward the bottom surface of the massage platform, and the top surface separates at a hinge along the central seam. As such, in the folded configuration, the top surface of the massage platform forms an exterior surface of the transportable, folded table.

However, due to their design, traditional portable massage tables suffer from certain deficiencies. These deficiencies include a weakened middle section that, in some cases, suffers from sagging toward a ground surface, primarily due to the central seam and a lack of a middle set of legs. In addition, due to the seam and the traditional minimalist design transportation of portable massage tables is difficult and cumbersome, often utilizing a thin piece of fabric located at the seam. Similarly, any peripherals used in combination with the table (such as bolsters, sheets, tables, braces, and other devices typically used during massage and physical therapy) must be transported separately. Moreover, when folded, the exterior surface of the table is exposed, thereby risking damage; this is particularly true if a cushioned surface is used on the exterior surface of the table.

Accordingly, what is needed is an improved portable and transformable massage table that resembles a carrying case or suitcase in a folded configuration, and that efficiently transforms into a massage table in a deployed configuration. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies, and the definition of that term in the reference does not apply.

While certain aspects of conventional technologies have been discussed to facilitate disclosure of the invention, Applicant in no way disclaims these technical aspects. It is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a portable and transformable massage table and a method of transforming a carrying case into a massage table is now met by a new, useful, and nonobvious invention.

The novel portable and transformable massage table includes an outer shell including a first portion coupled to a second portion. The first and second portions each include a first edge, with the first edge of each of the first and second portions being coupled at a hinge, such that interior surfaces of the outer shell define an interior compartment in a folded configuration of the outer shell. The folded configuration includes the first portion and the second portion being coupled together at each first edge and at opposing second edges of each of the first and second portions. In some embodiments, the table includes a handle disposed on an upper surface of the outer shell and at least one wheel disposed on a lower surface of the outer shell.

The table includes a proximal leg secured to an interior surface of the first portion, and a distal leg secured to an interior surface of the second portion. In a deployed configuration, an outer surface of first portion and an outer surface of the second portion form a planar table surface. In addition, in the deployed configuration, the proximal leg extends in a direction away from the first portion and the distal leg extends in a direction away from the second portion. As such, the proximal and distal legs are configured to rest on a ground surface, such that the planar table surface is disposed at a height above the ground surface. In an embodiment, the table includes a terminal foot secured to each of the proximal leg and the distal leg. Each terminal foot is rotatable with respect to the proximal leg and the distal leg, such that each terminal foot is configured to rest on and conform to the ground surface.

The table includes a massage table having a pair of opposing fabric covers that encase an open cell foam layer, and a valve secured to an outer edge of the massage table.

The valve is in fluidic communication with the open cell foam layer and forms a channel to an environment exterior to the fabric covers. The massage table is sized and shaped to rest on the planar table surface. The massage table increases in volume in the deployed configuration via fluid flow into the open cell foam layer via the valve. Similarly, the massage table decreases in volume in the folded configuration via fluid flow out of the open cell foam layer via the valve, such that the massage table is storable within the interior compartment. In an embodiment, the massage table is seamless.

In an embodiment, one or more clasps are secured to one of the first portion and the second portion and extend in a direction toward the opposing portion. The one or more clasps are configured to attach to an exert a pulling force on the opposing portion to secure the first portion to the second portion.

In some embodiments, the table includes a central leg secured to the outer shell in the deployed configuration. The central leg is disposed between the proximal leg and the distal leg. In addition, the central leg is detachable from the outer shell and storable within the interior compartment in the folded configuration. In an embodiment, a brace extends radially from at least one of an interior surface of the first portion and an interior surface of the second portion, such that the central leg secures to the brace in the deployed configuration.

In an embodiment, a bolster is removably storable within the interior compartment. The bolster includes a pair of opposing fabric covers that encase an open cell foam layer, and a valve secured to an outer edge of the bolster. The valve is in fluidic communication with the open cell foam layer and forming a channel to an environment exterior to the fabric covers. The bolster has a volume and a surface area smaller than the volume and a surface area of the massage table, such that the bolster is configured to rest on the massage table in the deployed configuration.

In some embodiments, a headrest is removably storable within the interior compartment. The headrest is removably securable to a proximal end of the planar table surface, such that the headrest extends in a direction away from an opposing distal end of the planar table surface.

In embodiments, one or more side tables are removably storable within the interior compartment, with each of the one or more side tables being removably securable to a side surface of the planar table surface. In an embodiment, a fabric sheet is removably storable within the interior compartment. In some embodiments, the fabric sheet includes at least one extension of material that defines at least one interior sleeve, such that the fabric sheet is configured to cover the massage table and the one or more side tables.

The novel method of transforming a carrying case into a massage table includes a step of separating a proximal end of a first portion of an outer shell from a distal end of a second portion of the outer shell, such that a distal end of the first portion and a proximal end of the second portion are secured together via a hinge. The method includes a step of extending a proximal leg in a direction away from the first portion, such that a terminal end of the proximal leg is configured to rest on a ground surface, with the proximal leg being secured to an interior surface of the first portion. Similarly, the method includes a step of extending a distal leg in a direction away from the second portion, such that a terminal end of the distal leg is configured to rest on the ground surface, with the distal leg being secured to an interior surface of the second portion.

The method includes a step of forming a planar table surface via an outer surface of first portion of the outer shell and an outer surface of the second portion of the outer shell. The method includes a step of increasing a volume of a massage table via fluid flow through a valve. The massage table includes a pair of opposing fabric covers that encase an open cell foam layer, and the valve is secured to an outer edge of the massage table. The valve is in fluidic communication with the open cell foam layer and forming a channel to an environment exterior to the fabric covers. The massage table is coupled to the planar surface, with the massage table being sized and shaped to rest on the planar table surface.

In an embodiment, the step of separating the first portion of the outer shell from the second portion of the outer shell includes disconnecting one or more clasps from one of the first portion and the second portion. The one or more clasps are secured to one of the first portion and the second portion and extend in a direction toward the opposing portion. The one or more clasps are configured to attach to and exert a pulling force on the opposing portion to secure the first portion to the second portion.

In an embodiment, the method includes a step of disposing the terminal end of each of the proximal leg and the distal leg on the ground surface via a terminal foot. Each terminal foot is rotatable with respect to the proximal leg and the distal leg, such that each terminal foot is configured to rest on and conform to the ground surface. In some embodiments, a central leg is secured to a brace of the outer shell, the central leg being disposed between the proximal leg and the distal leg, with the brace extending radially from at least one of an interior surface of the first portion and an interior surface of the second portion.

In some embodiments, the method includes a step of increasing a volume of a bolster via fluid flow through a valve. The bolster is removably storable within an interior compartment defined by interior surfaces of the outer shell, with the bolster including a pair of opposing fabric covers that encase an open cell foam layer, and the valve secured to an outer edge of the bolster. The valve is in fluidic communication with the open cell foam layer and forms a channel to an environment exterior to the fabric covers. The bolster has a volume and a surface area smaller than the volume and a surface area of the massage table, such that the bolster is configured to rest on the massage table.

In an embodiment, the method includes a step of securing a headrest to the planar table surface. The headrest is removably storable within an interior compartment defined by interior surfaces of the outer shell. The headrest is securable to a proximal end of the planar table surface, such that the headrest extends in a direction away from an opposing distal end of the planar table surface.

In some embodiments, at least one side table is secured to the planar table surface. The at least one side table is removably storable within an interior compartment defined by interior surfaces of the outer shell. The at least one side table is securable to a side surface of the planar table surface. In an embodiment, the method includes a step of securing a fabric sheet to the massage table. The fabric sheet is removably storable within an interior compartment defined by interior surfaces of the outer shell. In an embodiment, the fabric sheet includes at least one extension of material that defines at least one interior sleeve, such that the fabric sheet is configured to cover the massage table and the one or more side tables.

In an embodiment, the method includes a step of transforming the massage table into the carrying case by decreasing the volume of the massage table via fluid flow out of the open cell foam layer via the valve. The massage table is stored within an interior compartment defined by interior surfaces of the outer shell. The method includes a step of folding each of the proximal leg and the distal leg in a direction toward the outer shell, such that each of the proximal leg and the distal leg is stored within the interior compartment. The proximal end of the first portion of the outer shell couples with the distal end of the second portion of the outer shell. The method includes a step of securing the first portion of the outer shell to the second portion of the outer shell via one or more clasps. The one or more clasps are secured to one of the first portion and the second portion and extending in a direction toward the opposing portion, with the one or more clasps being configured to attach to and exert a pulling force on the opposing portion.

An object of the invention is to efficiently and effectively transport a portable massage table and various peripherals traditionally used in providing massage and/or physical therapy within a singular portable device.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
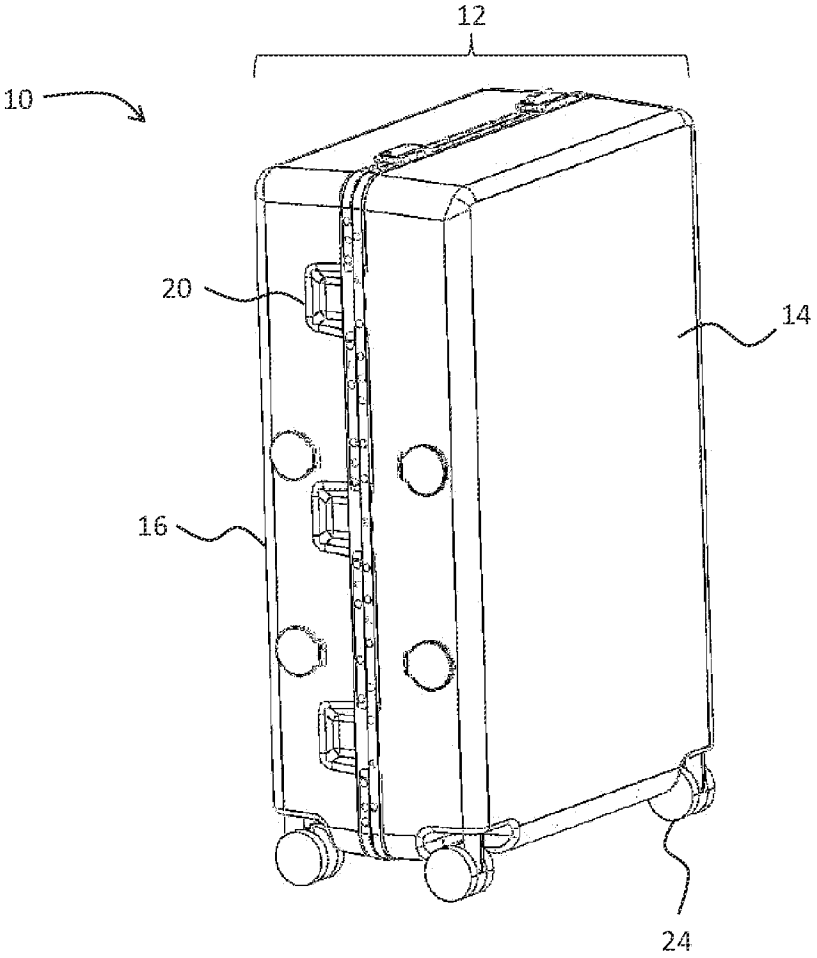
FIG. 1 is a perspective view of a portable and transformable massage table in a folded configuration, in accordance with an embodiment of the present invention.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

All numerical designations, such as measurements, efficacies, physical characteristics, forces, and other designations, including ranges, are approximations which are varied up or down by increments of 1.0 or 0.1, as appropriate. It is to be understood, even if it is not always explicitly stated that all numerical designations are preceded by the term "about." As used herein, "about" or "approximately" refers to being within an acceptable error range for the particular value as determined by one of ordinary skill in the art, which will depend in part on how the value is measured or determined. As used herein, the term "about" refers to +15% of the numerical; it should be understood that a numerical including an associated range with a lower boundary of greater than zero must be a non-zero numerical, and the term "about" should be understood to include only non-zero values in such scenarios.

The phrases "in some embodiments," "in an embodiment," "according to some embodiments," "in the embodiments shown," "in other embodiments," and the like generally mean the particular feature, structure, or characteristic following the phrase is included in at least one implementation. In addition, such phrases do not necessarily refer to the same embodiments or different embodiments.

The present invention includes a portable and transformable massage table that includes a folded configuration in which the table is easily transportable within a singular container, similar to a travel case or suitcase, as well as a deployed configuration for use in massage and/or physical therapy. During transportation in the folded configuration, each component of the table is contained within an internal compartment defined by the singular container, thereby facilitating the movement of the massage table between locations for use during therapy sessions. Upon arrival at a target location, the singular compartment efficiently unfolds into the deployed configuration, in which an exterior surface of the compartment serves as a surface of the massage table. In addition, the components stored within the compartment in the folded configuration are removable for use in the deployed configuration. The portable and transformable massage table will be described in greater detail in the sections herein below.

Referring to FIG. 1, an embodiment of portable and transformable massage table 10 (alternatively referred to herein as "portable table 10," "massage table 10," or "table 10") includes outer shell 12; in an embodiment, outer shell 12 includes first portion 14 and second portion 16, with first portion 14 being coupled to second portion 16 at hinge 18. As such, first portion 14 and second portion 16 are separable from each other while remaining joined together at hinge 18, such that in a deployed configuration, an outer surface of first portion 14 and an outer surface of second portion 16 form a planar surface. The deployed configuration will be described in greater detail in the sections below.

In a folded configuration, first portion 14 and second portion 16 are joined together at hinge 18 and along an edge surface of each of first portion 14 and second portion 16, such that first portion 14 and second portion 16 together define an interior compartment of portable table 10. To secure first portion 14 and second portion 16 together, an embodiment of table 10 includes one or more clasps 20 along one or more edge surfaces of first portion 14 and/or second portion 16. The one or more clasps 20 extend in a direction away from one or more of first portion 14 and second portion 16, exerting a pulling force on the opposing portion, thereby securing first portion 14 and second portion 16 together in the absence of an external force (such as a user exerting a force on one or more clasps 20 that is greater than the pulling force of the one or more clasps 20, thereby disengaging the one or more clasps 20).

Figure 3:
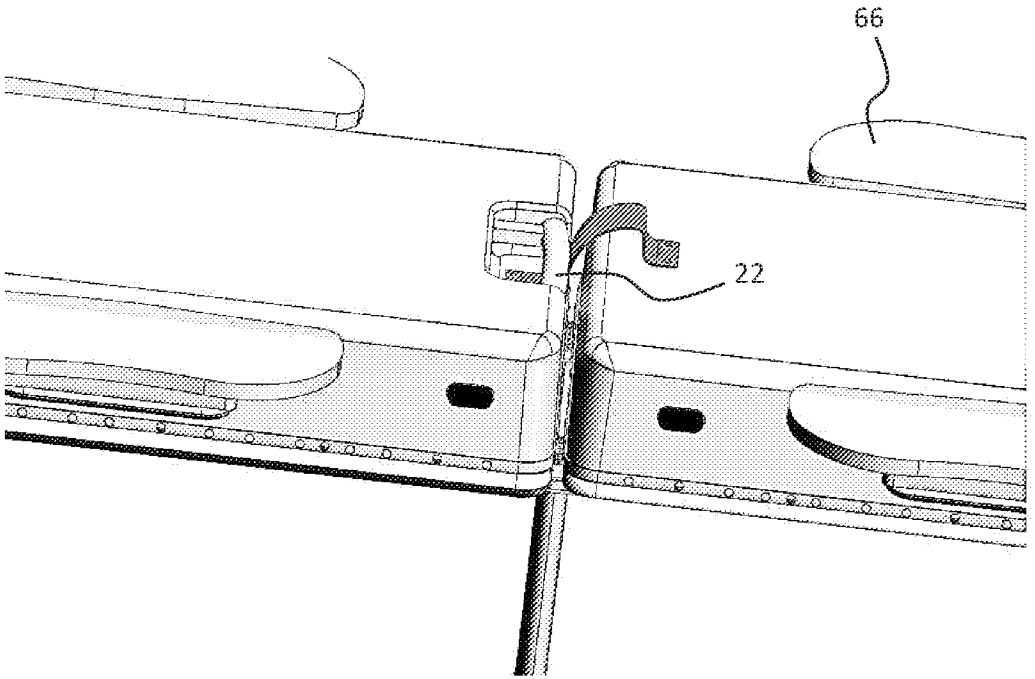
FIG. 3 is a perspective view of an exterior table surface of a portable and transformable massage table in a partially deployed configuration, in accordance with an embodiment of the present invention.
Figure 4:
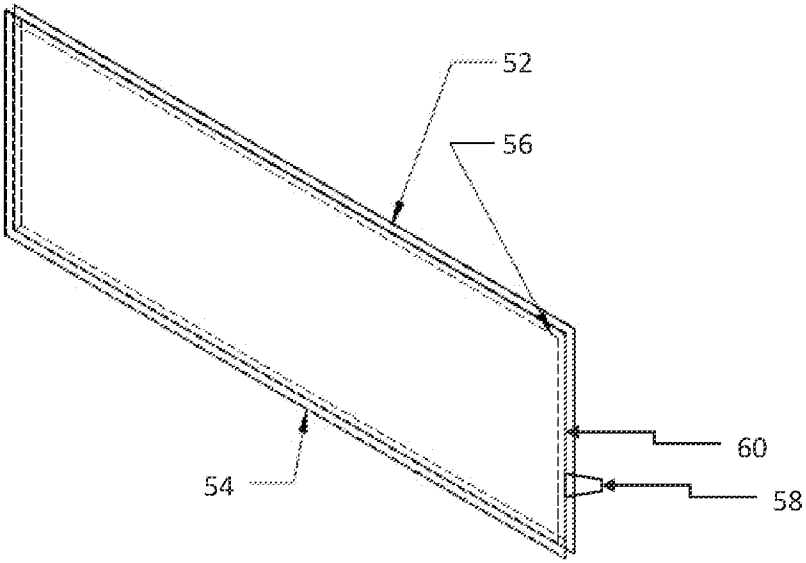
FIG. 4 is a perspective view of an inflatable massage table, in accordance with an embodiment of the present invention.
Figure 5:
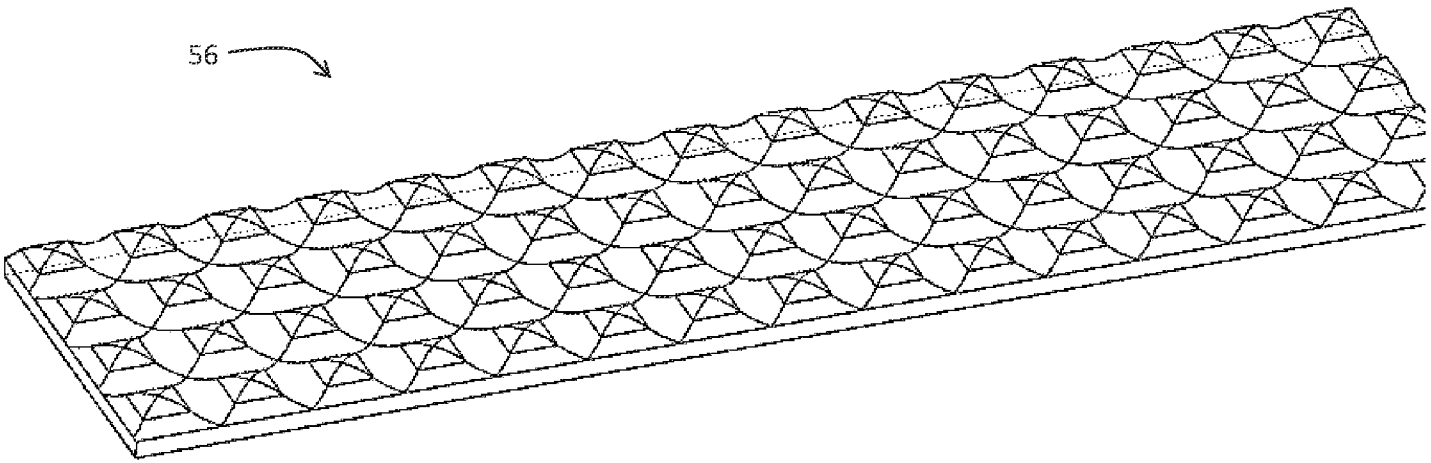
FIG. 5 is an internal view of the inflatable massage table of FIG. 4, in accordance with an embodiment of the present invention.
Figure 6:
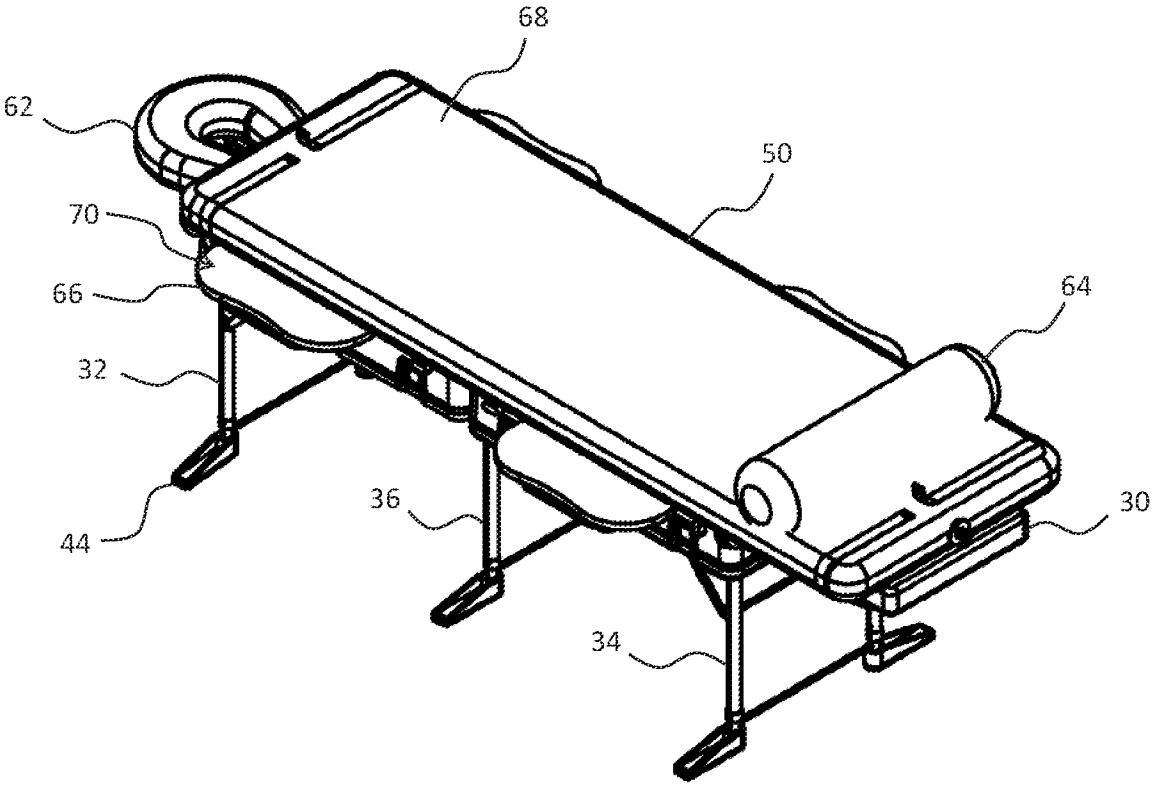
FIG. 6 is a perspective top view of a portable and transformable massage table in a deployed configuration, in accordance with an embodiment of the present invention.
Figure 7:
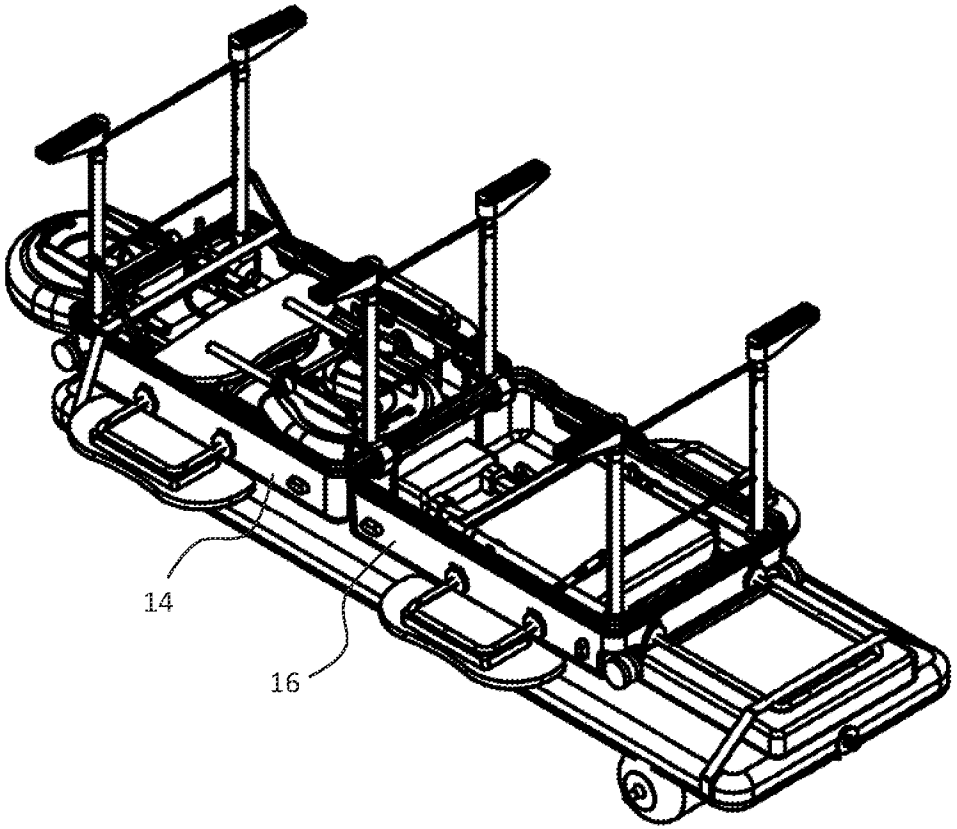
FIG. 7 is a perspective bottom view of the portable and transformable massage table of FIG. 6 in a deployed configuration, in accordance with an embodiment of the present invention.

In an embodiment, in the folded configuration, first portion 14 and second portion 16 together define an upper surface of table 10 and an opposing lower surface of table 10. In addition, in an embodiment, the upper surface of table 10 includes handle 22 (shown in particular in FIG. 3; in some embodiments, a fabric is used to further connect first portion 14 and second portion 16 at handle 22), and the lower surface of table 10 includes at least one wheel 24 (shown in particular in FIG. 1). As such, during transportation of table 10 in the folded configuration, the at least one wheel 24 is configured to contact a ground surface, thereby facilitating a transportation of table 10 via the at least one wheel 24. In addition, during transportation of table 10 in the folded configuration, the handle is graspable by a user to manipulate and maneuver table 10 along the ground surface.

Figure 2:
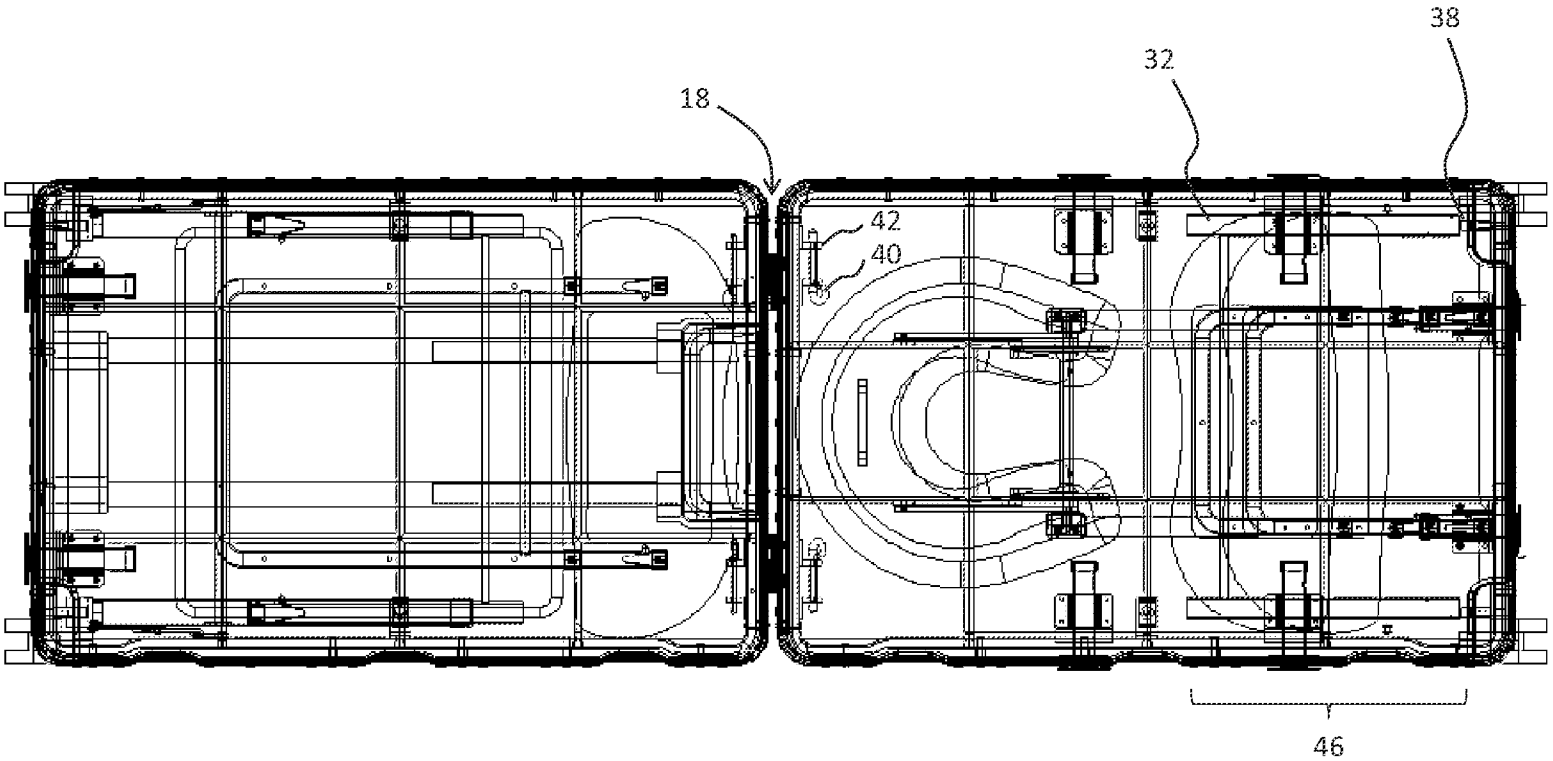
FIG. 2 is a perspective view of an interior compartment of a portable and transformable massage table in a partially deployed configuration, depicting the components of the portable and transformable massage table stored within the interior compartment of the portable and transformable massage table, in accordance with an embodiment of the present invention.

Turning to the deployed configuration (particularly FIGS. 2-3), in an embodiment, first portion 14 and second portion 16 separate from each other along side edges of each of first portion 14 and second portion 16, as well as a lateral edge of each of first portion 14 and second portion 16. As such, in the deployed configuration, first portion 14 and second portion 16 remain attached at hinge 18, as the portions of table 10 pivot away from each other about hinge 18. In the deployed configuration, first portion 14 and second portion 16 together form a planar table surface 30, which is comprised of an external component of each of first portion 14 and second portion 16; in the folded configuration, the external component of each of first portion 14 and second portion 16 together form outer shell 12 of table 10.

Upon being unfolded into the deployed configuration, a plurality of leg components are extendable from within an interior compartment of table 10 toward a ground surface, such as the floor of a medical facility, thereby creating a standing version of table 10. In an embodiment, table 10 includes at least one forward (or proximal) leg 32 and at least one opposing rear (or distal) leg 34, with each of forward leg 32 and rear leg 34 being secured to an interior surface of table 10 via hinge 38. As such, in an embodiment, in the folded configuration, the at least one forward leg 32 and the at least one rear leg 34 pivot to be stored within the interior compartment of table 10. Similarly, in the deployed configuration, a terminal edge of each of the at least one forward leg 32 and the at least one rear leg 34 pivot away from the interior compartment of table 10 and toward a ground surface, such that each of the at least one forward leg 32 and the at least one rear leg 34 is substantially perpendicular to table surface 30.

In an embodiment, table 10 includes at least one central leg 36 that is configured to secure to table 10 and extend in a direction toward a ground surface, similar to the at least one forward leg 32 and the at least one rear leg 34. In an embodiment, the at least one central leg 36 is removably secured to table 10, such that in the folded configuration, the at least one central leg 36 is not secured to table 10, but instead is stored within table 10 without a direct coupling between central leg 36 and table 10. However, in the deployed configuration, the at least one central leg 36 secures to table 10 to provide a stabilization leg between forward leg 32 and rear leg 34. In an embodiment, table 10 includes brace 42 that extends laterally from an interior surface of at least one of first portion 14 and second portion 16. Brace 42 defines an aperture therethrough, and is sized and shaped to receive central leg 36 therein. To secure central leg 36 to brace 42, at least one pin 40 is disposed through the aperture defined by brace 42, thereby retaining central leg 36 within brace 42. It should be appreciated that alternative fasteners are contemplated herein to removably secure central leg 36 to brace 42, such as mechanical fasteners (including alternative pins, screws, bolts, cams, and similar fasteners), magnetic fasteners, adhesives, and similar securing mechanisms. In addition, it should be appreciated that a pair of central legs 36 can be secured to table 10; for example, in an embodiment, a first central leg 36 secures to first portion 14 and a second central leg 36 secures to second portion 16, such that two central legs 36 secure to both table 10 and a ground surface.

In an embodiment, one or more of forward leg 32, rear leg 34, and central leg 36 includes rotatable foot 44 pivotably secured to a terminal end thereof, such that foot 44 is configured to rest on a ground surface in the deployed configuration. Each foot 44 is configured to rotate approximately 360° with respect to the terminal end of the leg to which foot 44 is secured, thereby allowing the placement of each foot 44 on the ground surface to be selected and altered, depending on the dimension of the area surrounding table 10 in the deployed configuration. In addition, the rotation of foot 44 is such that table 10 can be deployed on an uneven ground surface by rotating foot 44 to configure to shape of the ground surface.

In some embodiments, one or more of forward leg 32, rear leg 34, and central leg 36 include a telescoping component, such that a height of the leg can be adjusted via the telescoping component. For example, in an embodiment, at least one of forward leg 32, rear leg 34, and central leg 36 includes an outer wall and a telescoping inner wall, such that the telescoping inner wall is adjustable with respect to the outer wall. It should be appreciated that in alternative embodiments, the legs can include a telescoping outer wall and an inner wall.

Turning to FIGS. 4-7, after being unfolded in the deployed configuration, table surface 30 is configured to be used during a therapy session, such as massage therapy or physical therapy. In conventional portable massage tables, the exterior surface of the folded table becomes the table surface configured to receive a patient in a prone, supine, lateral recumbent, or similar position. However, such a shared surface risks damage to the exterior surface of the table, thereby limiting the long-term use of the table, and requiring additional stored items to be transported separately with the table.

Accordingly, table 10 includes massage table 50 stored within the interior compartment of table during the folded configuration. Massage table 50 includes open cell foam layer 56 that is disposed between opposing fabric covers 52, 54; in an embodiment, fabric covers 52, 54 are made of a waterproof and airtight fabric material to reduce contamination of the fabric during use of massage table 50. Massage table 50 includes outer flange 58 disposed on an edge thereof to bond fabric cover 52 to fabric cover 54, thereby sealing open cell foam layer 56 between fabric covers 52, 54.

In addition, massage table 50 includes valve 58 disposed on an edge of massage table 50, with valve 58 defining a channel between an environment exterior to massage table 50 and open cell foam layer 56 disposed within massage table 50. In an embodiment, valve 58 includes a closed configuration in which valve 58 prevents fluid (such as gas) flow, and an open configuration in which valve 58 allows fluid flow. As such, in the open configuration, valve 58 allows fluid to selectively flow into and out of open cell foam layer 56 of massage table 50. In an embodiment, a pump is fluidically coupled to valve 58 to facilitate fluid flow into and out of open cell foam layer 56. When inflated via fluid flow through valve 58, massage table 50 is configured to rest on table surface 30 of table 10, such that massage table 50 is configured to receive a patient thereon for a massage and/or physical therapy session. When deflated via fluid flow out of valve 58, massage table 50 is configured to reduce in volume to be stored within the interior compartment of table 10 in the folded configuration. In an embodiment, massage table 50 is seamless on a planar top surface thereof, such that massage table 50 withholds its shape in the presence of a patient thereon, and such that the patient does not rest on a seam disposed within massage table 50.

In some embodiments, various peripherals are storable within table 10 in a folded configuration, such that the peripherals are securable to table 10 in a deployed configuration. For example, in an embodiment, headrest 62 is securable to a front edge surface of table 10, such as via a proximal end of table surface 30. Headrest 62 is securable to table 10 a mechanical or magnetic fastener, such that headrest 62 is removably secured to table 10. In an embodiment, headrest 62 includes an open cell foam layer and a valve similar to that of massage table 50, such that headrest 62 is capable of selective inflation and deflation during deployment and storage, respectively. In embodiments, headrest 62 includes an outer surface that defines an interior aperture, such that headrest 62 is configured to receive a head of a patient during use of massage table 50.

In addition, in some embodiments, bolster 64 is included within table 10 in a folded configuration for storage within table 10, such that bolster 64 is removable from table 10 in a deployed configuration for use during a massage and/or physical therapy session. In an embodiment, bolster 64 includes an open cell foam layer and a valve similar to that of massage table 50, such that bolster 64 is capable of selective inflation and deflation during deployment and storage, respectively. In some embodiments, bolster 64 is selectively securable to massage table 50, such as via a strap, a magnetic fastener, a hook-and-loop fastener, and similar fasteners, such that bolster 64 is secured in place against massage table 50. In some embodiments, bolster 64 is formed together with massage table 50, such that bolster 64 shares an interior compartment with an interior compartment of massage table 50, and such that bolster 64 and massage table 50 inflate and deflate together via valve 58.

In an embodiment, one or more side tables 66 are securable to table 10, such as via table surface 30, in a deployed configuration, such that various therapy items can be temporarily stored on the one or more side tables 66 during use of massage table 50. In an embodiment, the one or more side tables 66 are securable to table 10 via a fastener, such as a brace, clamp, pin, screw, bolt, cam, hook-and-loop, bracket, magnet, adhesive, or a similar fastener, such that the one or more side tables 66 are selectively securable to and removable from table 10. In some embodiments, the one or more side tables 66 are slidably secured to table 10, such that table 10 includes a discontinuous outer surface and the one or more side tables 66 retract into the interior compartment of table 10.

In some embodiments, fabric sheet 68 that is sized and shaped to secure to massage table 50 is storable within table 10 in a folded configuration. In an embodiment, fabric sheet 68 is made of a cotton blend, such as a 60/40 cotton blend; in other embodiments, fabric sheet 68 is made of an alternative fabric, such as a pure fabric material, an alternative blend of materials, a single or mixture of synthetic materials, and similar materials. In some embodiments, fabric sheet 68 includes exterior extensions of material that define interior sleeves 70, such that interior sleeves 70 are sized and shaped to fit over and cover the one or more side tables 66. Similarly, in some embodiments, fabric sheet includes exterior extensions of material that define interior sleeves 70, such that interior sleeves 70 are sized and shaped to fit over and cover headrest 62.

Upon transitioning table 10 from the deployed configuration to the folded configuration, the components that rest upon table surface 30 (such as, in various embodiments, massage table 50, headrest 62, bolster 64, side tables 66, and fabric sheet 68) are removable from table 10 for storage within the interior compartment defined by table 10. Similarly, the one or more central legs 36 (together with feet 44, pins 40, and, in some embodiments, brace 42) are removable from a bottom side of table surface 30 for storage within one or more of first portion 14 and second portion 16. After storing the removable components, each of forward legs 32 and rear legs 34 are storable within one of first portion 14 and/or second portion 16 by pivoting in a direction toward outer shell 12 via hinge 18. As such, each component used in combination with table 10 is storable within the interior compartment for efficient transportation between locations.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A portable and transformable massage table comprising:

an outer shell including a first portion coupled to a second portion, the first and second portions each including a first edge, the first edge of each of the first and second portions coupled at a hinge, such that interior surfaces of the outer shell define an interior compartment in a folded configuration of the outer shell, wherein the folded configuration includes the first portion and the second portion being coupled together at each first edge and at opposing second edges of each of the first and second portions;

one or more wheels mechanically coupled to a bottom surface of at least one portion of the outer shell;

a telescoping handle mechanically coupled to a top surface of a portion of the outer shell;

a proximal leg secured to an interior surface of the first portion;

a distal leg secured to an interior surface of the second portion;

an extension panel storable within the interior compartment of the outer shell;

one or more securement latches removably storable within the interior compartment of the outer shell;

a planar table surface formed by an outer surface of first portion and an outer surface of the second portion in a deployed configuration of the outer shell;

a massage table including a pair of opposing fabric covers that encase an open cell foam layer, and a valve secured to an outer edge of the massage table, the valve in fluidic communication with the open cell foam layer and forming a channel to an environment exterior to the fabric covers, the massage table being sized and shaped to rest on the planar table surface;

wherein the proximal leg extends in a direction away from the first portion and the distal leg extends in a direction away from the second portion in the deployed configuration, such that the proximal and distal legs are configured to rest on a ground surface, and such that the planar table surface is disposed at a height above the ground surface;

wherein the extension panel is removably securable to a distal end of the planar table surface;

wherein the massage table is configured to increase in volume in the deployed configuration via fluid flow into the open cell foam layer via the valve;

wherein the massage table is configured to decrease in volume in the folded configuration via fluid flow out of the open cell foam layer via the valve, such that the massage table is storable within the interior compartment;

wherein the one or more securement latches are configured to mechanically couple the massage table to the planar table surface in the deployed configuration; and wherein when in a folded configuration the outer shell is a portable, rigid container.

2. The portable and transformable massage table of claim 1, further comprising one or more clasps secured to one of the first portion and the second portion and extending in a direction toward the opposing portion, wherein the one or more clasps are configured to attach to and exert a pulling force on the opposing portion to secure the first portion to the second portion.

3. The portable and transformable massage table of claim 1, further comprising a terminal foot secured to each of the proximal leg and the distal leg, each terminal foot being rotatable with respect to the proximal leg and the distal leg, such that each terminal foot is configured to rest on and conform to the ground surface.

4. The portable and transformable massage table of claim 1, further comprising a central leg secured to the outer shell in the deployed configuration, the central leg disposed between the proximal leg and the distal leg, wherein the central leg is detachable from the outer shell and storable within the interior compartment in the folded configuration.

5. The portable and transformable massage table of claim 4, further comprising a brace extending radially from at least one of an interior surface of the first portion and an interior surface of the second portion, wherein the central leg secures to the brace in the deployed configuration.

6. The portable and transformable massage table of claim 1, wherein a planar top surface of the massage table is seamless.

7. The portable and transformable massage table of claim 1, further comprising a bolster removably storable within the interior compartment, the bolster including a pair of opposing fabric covers that encase an open cell foam layer, and a valve secured to an outer edge of the bolster, the valve in fluidic communication with the open cell foam layer and forming a channel to an environment exterior to the fabric covers, the bolster having a volume and a surface area smaller than the volume and a surface area of the massage table, such that the bolster is configured to rest on the massage table in the deployed configuration.

8. The portable and transformable massage table of claim 1, further comprising a headrest removably storable within the interior compartment, the headrest removably securable to a proximal end of the planar table surface, such that the headrest extends in a direction away from an opposing distal end of the planar table surface.

9. The portable and transformable massage table of claim 1, further comprising one or more side tables removably storable within the interior compartment, each of the one or more side tables removably securable to a side surface of the planar table surface.

10. The portable and transformable massage table of claim 9, further comprising a fabric sheet removably storable within the interior compartment, the fabric sheet including at least one extension of material that defines at least one interior sleeve, such that the fabric sheet is configured to cover the massage table and the one or more side tables.

11. A method of transforming a carrying case into a massage table, the method comprising the steps of:

separating a proximal end of a first portion of an outer shell from a distal end of a second portion of the outer shell, such that a distal end of the first portion and a proximal end of the second portion are secured together via a hinge;

extending a proximal leg in a direction away from the first portion, such that a terminal end of the proximal leg is configured to rest on a ground surface, the proximal leg being secured to an interior surface of the first portion;

extending a distal leg in a direction away from the second portion, such that a terminal end of the distal leg is configured to rest on the ground surface, the distal leg being secured to an interior surface of the second portion;

forming a planar table surface via an outer surface of first portion of the outer shell and an outer surface of the second portion of the outer shell;

increasing a volume of a massage table via fluid flow through a valve, the massage table including a pair of opposing fabric covers that encase an open cell foam layer, and the valve secured to an outer edge of the massage table, the valve in fluidic communication with the open cell foam layer and forming a channel to an environment exterior to the fabric covers;

securing an extension panel to the planar table surface, the extension panel being removably storable within an interior compartment defined by interior surfaces of the outer shell, the extension panel being removably securable to a distal end of the planar table surface, such that the extension panel extends in a direction away from an opposing proximal end of the planar table surface; and coupling the massage table to the planar table surface via one or more securement latches, the massage table being sized and shaped to rest on the planar table surface.

12. The method of claim 11, wherein the step of separating the first portion of the outer shell from the second portion of the outer shell further comprises the step of disconnecting one or more clasps from one of the first portion and the second portion, the one or more clasps secured to one of the first portion and the second portion and extending in a direction toward the opposing portion, wherein the one or more clasps are configured to attach to and exert a pulling force on the opposing portion to secure the first portion to the second portion.

13. The method of claim 11, further comprising the step of disposing the terminal end of each of the proximal leg and the distal leg on the ground surface via a terminal foot, each terminal foot being rotatable with respect to the proximal leg and the distal leg, such that each terminal foot is configured to rest on and conform to the ground surface.

14. The method of claim 11, further comprising the step of securing a central leg to a brace of the outer shell, the central leg disposed between the proximal leg and the distal leg, the brace extending radially from at least one of an interior surface of the first portion and an interior surface of the second portion.

15. The method of claim 11 further comprising the step of increasing a volume of a bolster via fluid flow through a valve, the bolster being removably storable within an interior compartment defined by interior surfaces of the outer shell, the bolster including a pair of opposing fabric covers that encase an open cell foam layer, and the valve secured to an outer edge of the bolster, the valve in fluidic communication with the open cell foam layer and forming a channel to an environment exterior to the fabric covers, the bolster having a volume and a surface area smaller than the volume and a surface area of the massage table, such that the bolster is configured to rest on the massage table.

16. The method of claim 11 further comprising the step of securing a headrest to the planar table surface, the headrest being removably storable within an interior compartment defined by interior surfaces of the outer shell, the headrest being securable to a proximal end of the planar table surface, such that the headrest extends in a direction away from an opposing distal end of the planar table surface.

17. The method of claim 11 further comprising the step of securing at least one side table to the planar table surface, the at least one side table being removably storable within an interior compartment defined by interior surfaces of the outer shell, the at least one side table being securable to a side surface of the planar table surface.

18. The method of claim 17 further comprising the step of securing a fabric sheet to the massage table, the fabric sheet being removably storable within an interior compartment defined by interior surfaces of the outer shell, the fabric sheet including at least one extension of material that defines at least one interior sleeve, such that the fabric sheet is configured to cover the massage table and the one or more side tables.

19. The method of claim 11 further comprising the step of transforming the massage table into the carrying case by:

decreasing the volume of the massage table via fluid flow out of the open cell foam layer via the valve;

storing the massage table within an interior compartment defined by interior surfaces of the outer shell;

folding each of the proximal leg and the distal leg in a direction toward the outer shell, such that each of the proximal leg and the distal leg is stored within the interior compartment;

coupling the proximal end of the first portion of the outer shell with the distal end of the second portion of the outer shell; and securing the first portion of the outer shell to the second portion of the outer shell via one or more clasps, the one or more clasps secured to one of the first portion and the second portion and extending in a direction toward the opposing portion, wherein the one or more clasps are configured to attach to and exert a pulling force on the opposing portion.

* * * * *